US011819989B2

(12) United States Patent
Knight et al.

(10) Patent No.: US 11,819,989 B2
(45) Date of Patent: Nov. 21, 2023

(54) POWERED FASTENER DRIVER

(71) Applicant: TECHTRONIC CORDLESS GP, Anderson, SC (US)

(72) Inventors: Tyler H. Knight, Greenville, SC (US); Austin Clark, Seneca, SC (US)

(73) Assignee: Techtronic Cordless GP, Anderson, SC (US)

( * ) Notice: Subject to any disclaimer, the term of this patent is extended or adjusted under 35 U.S.C. 154(b) by 82 days.

(21) Appl. No.: 17/362,435

(22) Filed: Jun. 29, 2021

(65) Prior Publication Data

US 2022/0009067 A1 Jan. 13, 2022

Related U.S. Application Data

(60) Provisional application No. 63/048,868, filed on Jul. 7, 2020.

(51) Int. Cl.
*B25C 1/04* (2006.01)
*B25C 1/06* (2006.01)

(52) U.S. Cl.
CPC ..... *B25C 1/047* (2013.01); *B25C 1/042* (2013.01); *B25C 1/06* (2013.01)

(58) Field of Classification Search
CPC ..... B25C 1/042; B25C 1/047; B25C 1/06; B25C 5/13
See application file for complete search history.

(56) References Cited

U.S. PATENT DOCUMENTS

| | | | | |
|---|---|---|---|---|
| 317,212 | A | 5/1885 | Rubin | |
| 942,163 | A | 12/1909 | Berner | |
| 1,072,358 | A | 9/1913 | Palmros | |
| 1,072,367 | A | 9/1913 | Sibley | |
| 1,829,609 | A | 10/1931 | Robinson | |
| 3,035,268 | A | 5/1962 | Goldring | |
| 3,150,488 | A | 9/1964 | Haley | |
| 3,288,339 | A | 11/1966 | Bade | |
| 3,567,098 | A | 3/1971 | Maynard | |
| 3,568,780 | A * | 3/1971 | Matsuo | B25D 11/125 60/537 |
| 3,754,396 | A | 8/1973 | Erma | |
| 3,847,321 | A | 11/1974 | Charlez | |
| 3,878,902 | A | 4/1975 | Matsuo | |
| 4,192,389 | A | 3/1980 | Raman | |
| 4,380,313 | A | 4/1983 | Klaus et al. | |

(Continued)

FOREIGN PATENT DOCUMENTS

| | | |
|---|---|---|
| CN | 1798954 A | 7/2006 |
| CN | 101389449 A | 3/2009 |

(Continued)

OTHER PUBLICATIONS

Snap-On, "18 Gauge 2" Brad Nailer," Model #870015 Instruction Manual, © 2007 (14 pages).

(Continued)

*Primary Examiner* — Joshua G Kotis
(74) *Attorney, Agent, or Firm* — Michael Best & Friedrich LLP

(57) ABSTRACT

A powered fastener driver includes a cylinder and a piston positioned within the cylinder. The piston is moveable between a top-dead-center position and a bottom-dead-center position. The piston has a non-circular shape.

19 Claims, 12 Drawing Sheets

(56) References Cited

U.S. PATENT DOCUMENTS

| | | | | |
|---|---|---|---|---|
| 4,415,110 | A | 11/1983 | Hunter | |
| 4,913,331 | A | 4/1990 | Utsumi et al. | |
| 5,111,890 | A | 5/1992 | Ranger et al. | |
| 5,720,423 | A | 2/1998 | Kondo et al. | |
| 6,158,643 | A | 12/2000 | Phillips | |
| 6,231,319 | B1 * | 5/2001 | Iida | F04C 18/10 417/462 |
| 6,484,814 | B2 | 11/2002 | Bongers-Ambrosius | |
| 6,604,666 | B1 | 8/2003 | Pedicini et al. | |
| 6,672,498 | B2 | 1/2004 | White et al. | |
| 6,705,503 | B1 | 3/2004 | Pedicini et al. | |
| 6,732,815 | B2 | 5/2004 | Hanke et al. | |
| 6,766,935 | B2 | 7/2004 | Pedicini et al. | |
| 6,874,452 | B2 * | 4/2005 | Adams | F02B 71/00 123/46 R |
| 6,971,567 | B1 | 12/2005 | Cannaliato et al. | |
| 7,032,683 | B2 | 4/2006 | Hetcher et al. | |
| 7,225,959 | B2 | 6/2007 | Patton et al. | |
| 7,325,711 | B2 | 2/2008 | Schiestl et al. | |
| 7,494,035 | B2 | 2/2009 | Weaver et al. | |
| 7,594,599 | B2 | 9/2009 | Webb | |
| 7,793,811 | B1 | 9/2010 | Pedicini et al. | |
| 7,980,440 | B2 | 7/2011 | Hahn et al. | |
| 7,984,708 | B2 | 7/2011 | Pedicini et al. | |
| 8,079,504 | B1 | 12/2011 | Pedicini et al. | |
| 8,091,751 | B2 | 1/2012 | Tanaka | |
| RE44,001 | E | 2/2013 | Pedicini et al. | |
| 8,523,035 | B2 | 9/2013 | Pedicini et al. | |
| 8,550,321 | B2 | 10/2013 | Webb | |
| 8,561,869 | B2 | 10/2013 | Towfighi | |
| 8,733,610 | B2 | 5/2014 | Pedicini | |
| 8,770,457 | B2 * | 7/2014 | Hamilton | B25D 9/20 227/10 |
| 8,800,834 | B2 | 8/2014 | Pedicini et al. | |
| 8,857,692 | B2 | 10/2014 | Shima et al. | |
| 8,875,969 | B2 | 11/2014 | Pedicini et al. | |
| 8,939,341 | B2 | 1/2015 | Pedicini et al. | |
| 9,050,712 | B2 | 6/2015 | Campbell | |
| 9,555,530 | B2 | 1/2017 | Pedicini et al. | |
| 9,662,777 | B2 | 5/2017 | Pomeroy et al. | |
| 9,770,818 | B2 * | 9/2017 | Largo | B25C 1/041 |
| 9,782,882 | B2 | 10/2017 | Wolf et al. | |
| 9,827,659 | B2 | 11/2017 | Matsuno | |
| 9,844,865 | B2 | 12/2017 | Furuta et al. | |
| 9,943,952 | B2 | 4/2018 | Kato | |
| 9,969,070 | B2 | 5/2018 | Campbell | |
| 10,058,985 | B2 | 8/2018 | Raggl et al. | |
| 10,076,830 | B2 | 9/2018 | Raggl et al. | |
| 10,131,047 | B2 | 11/2018 | Yanagihara et al. | |
| 10,201,892 | B2 | 2/2019 | Bruggmueller et al. | |
| 10,259,110 | B2 | 4/2019 | Bruggmueller et al. | |
| 10,272,553 | B2 | 4/2019 | Yang et al. | |
| 10,286,534 | B2 | 5/2019 | Kato | |
| 10,343,271 | B2 | 7/2019 | Campbell | |
| 10,471,579 | B2 | 11/2019 | Zhang | |
| 10,525,577 | B2 | 1/2020 | Masatoshi et al. | |
| 10,730,172 | B2 * | 8/2020 | Po | B25C 1/047 |
| 10,843,318 | B2 * | 11/2020 | Kobori | B25C 1/047 |
| 11,413,734 | B2 * | 8/2022 | Bradley | F16J 1/08 |
| 2004/0134961 | A1 | 7/2004 | Wolf et al. | |
| 2004/0232194 | A1 | 11/2004 | Pedicini et al. | |
| 2006/0180631 | A1 | 8/2006 | Pedicini et al. | |
| 2007/0181629 | A1 | 8/2007 | Chen et al. | |
| 2008/0054043 | A1 | 3/2008 | Beales | |
| 2008/0078799 | A1 | 4/2008 | Wen | |
| 2008/0217372 | A1 | 9/2008 | Webb | |
| 2008/0314952 | A1 | 12/2008 | Tamura et al. | |
| 2008/0314953 | A1 | 12/2008 | Moeller et al. | |
| 2009/0090759 | A1 | 4/2009 | Leimbach et al. | |
| 2010/0072248 | A1 | 3/2010 | Lai et al. | |
| 2011/0180581 | A1 | 7/2011 | Liang et al. | |
| 2012/0085226 | A1 * | 4/2012 | Thiele | F41A 5/18 89/191.01 |
| 2013/0336809 | A1 | 12/2013 | Antoun et al. | |
| 2014/0299646 | A1 | 10/2014 | Webb | |
| 2015/0053736 | A1 | 2/2015 | Pomeroy et al. | |
| 2015/0122868 | A1 * | 5/2015 | Campbell | B25C 1/047 227/130 |
| 2016/0144497 | A1 | 5/2016 | Boehm et al. | |
| 2017/0001291 | A1 | 1/2017 | Schnell et al. | |
| 2017/0043463 | A1 | 2/2017 | Schnell et al. | |
| 2017/0361442 | A1 | 12/2017 | Fairbanks et al. | |
| 2017/0361443 | A1 | 12/2017 | Sareault et al. | |
| 2018/0009097 | A1 | 1/2018 | Cheatham et al. | |
| 2018/0147709 | A1 * | 5/2018 | Masatoshi | B25D 9/08 |
| 2018/0207777 | A1 | 7/2018 | Cheatham et al. | |
| 2018/0243891 | A1 | 8/2018 | Dittrich et al. | |
| 2018/0370003 | A1 | 12/2018 | Schmidt | |
| 2018/0370006 | A1 | 12/2018 | Dittrich et al. | |
| 2019/0001474 | A1 | 1/2019 | Schmidt et al. | |
| 2019/0143498 | A1 | 5/2019 | Weber et al. | |
| 2019/0202042 | A1 | 7/2019 | Wu et al. | |
| 2019/0283225 | A1 | 9/2019 | Zhao et al. | |
| 2020/0061786 | A1 | 2/2020 | Zhang | |
| 2020/0189081 | A1 | 6/2020 | Yang et al. | |
| 2020/0238494 | A1 | 7/2020 | Li et al. | |
| 2020/0282534 | A1 * | 9/2020 | Po | B25C 1/06 |

FOREIGN PATENT DOCUMENTS

| | | | |
|---|---|---|---|
| CN | 102477973 | A | 5/2012 |
| CN | 204736190 | U | 11/2015 |
| CN | 206263884 | U | 6/2017 |
| CN | 107914242 | A | 4/2018 |
| CN | 207629980 | U | 7/2018 |
| CN | 108527255 | A | 9/2018 |
| CN | 109623736 | A | 4/2019 |
| CN | 209648625 | U | 11/2019 |
| CN | 110900524 | A | 3/2020 |
| CN | 210550947 | U | 5/2020 |
| CN | 112677109 | A | 4/2021 |
| CN | 112828827 | A | 5/2021 |
| DE | 1503164 | A1 | 3/1970 |
| DE | 3728454 | C2 | 3/1989 |
| EP | 1349711 | B1 | 2/2009 |
| FR | 1414089 | A | 10/1965 |
| GB | 1044288 | A | 9/1966 |
| JP | H0747270 | B2 | 5/1995 |
| JP | 2010059917 | A | 3/2010 |
| TW | 570864 | B | 1/2004 |
| WO | 02087831 | A2 | 11/2002 |
| WO | 2011010511 | A1 | 1/2011 |
| WO | 2011010512 | A1 | 1/2011 |
| WO | 2011010634 | A1 | 1/2011 |
| WO | 2012061295 | A1 | 5/2012 |
| WO | 2013161909 | A1 | 10/2013 |
| WO | 2013168719 | A1 | 11/2013 |
| WO | 2014061807 | A1 | 4/2014 |
| WO | 2014073669 | A1 | 5/2014 |
| WO | 2014084221 | A1 | 6/2014 |
| WO | 2014084222 | A1 | 6/2014 |
| WO | 2014087934 | A1 | 6/2014 |
| WO | 2017015654 | A1 | 1/2017 |
| WO | 2018128765 | A1 | 7/2018 |

OTHER PUBLICATIONS

Compliance Poster Company, "Nail Gun Use & Safety," © 1998 (1 page).

Oregon OSHA, "Pneumatic Nail and Staple Gun Safety," Hazard Alert, © 2009 (2 pages).

Paslode, "Pneumatic Tools," Operating and Maintenance Manual, © 2007 (32 pages).

Extended European Search Report for Application No. 21184108.5 dated Dec. 6, 2021 (9 pages).

* cited by examiner

POWERED FASTENER DRIVER

CROSS-REFERENCE TO RELATED APPLICATIONS

The present application claims priority to U.S. Provisional Patent Application No. 63/048,868 filed on Jul. 7, 2020, the entire content of which is incorporated herein by reference.

FIELD OF THE DISCLOSURE

The present disclosure relates to power tools, and more particularly to powered fastener drivers.

BACKGROUND OF THE DISCLOSURE

There are various fastener drivers used to drive fasteners (e.g., nails, tacks, staples, etc.) into a workpiece known in the art. These fastener drivers operate utilizing various energy sources (e.g., compressed air generated by an air compressor, electrical energy, flywheel mechanisms) known in the art, but often these designs are met with power, size, and cost constraints.

SUMMARY OF THE DISCLOSURE

The disclosure provides, in one aspect, a powered fastener driver including a cylinder and a piston positioned within the cylinder. The piston being moveable between a top-dead-center position and a bottom-dead-center position. The piston having a non-circular shape.

The disclosure provides, in another aspect, a powered fastener driver including a first cylinder, a first piston positioned within the first cylinder, the first piston being moveable between a top-dead-center position and a bottom-dead-center position, a pressure storage chamber in fluid communication with the first cylinder, a second cylinder in selective fluid communication with the pressure storage chamber, a second piston positioned within the second cylinder, the second piston being moveable between a top-dead-center position and a bottom-dead-center position to initiate a fastener driving operation, a drive blade coupled to the second piston for movement therewith, and a pressure valve positioned between the pressure storage chamber and the second cylinder. The pressure valve is configured to move from a closed position to an open position in response to the pressure within the pressure storage chamber reaching a threshold pressure.

The disclosure provides, in another aspect, a powered fastener driver including a first cylinder, a first piston positioned within the first cylinder, the first piston being moveable between a top-dead-center position and a bottom-dead-center position, a second cylinder in selective fluid communication with the first cylinder, a second piston positioned within the second cylinder, the second piston being moveable between a top-dead-center position and a bottom-dead-center position to initiate a fastener driving operation, a drive blade coupled to the second piston for movement therewith, and a check valve positioned between the second cylinder and the first cylinder, wherein the check valve is configured to open to permit air to flow into the first cylinder from the second cylinder.

Other aspects of the disclosure will become apparent by consideration of the detailed description and accompanying drawings.

Before any embodiments of the disclosure are explained in detail, it is to be understood that the present subject matter is not limited in its application to the details of construction and the arrangement of components set forth in the following description or illustrated in the following drawings. The present subject matter is capable of other embodiments and of being practiced or of being carried out in various ways.

DETAILED DESCRIPTION

Figure 1:
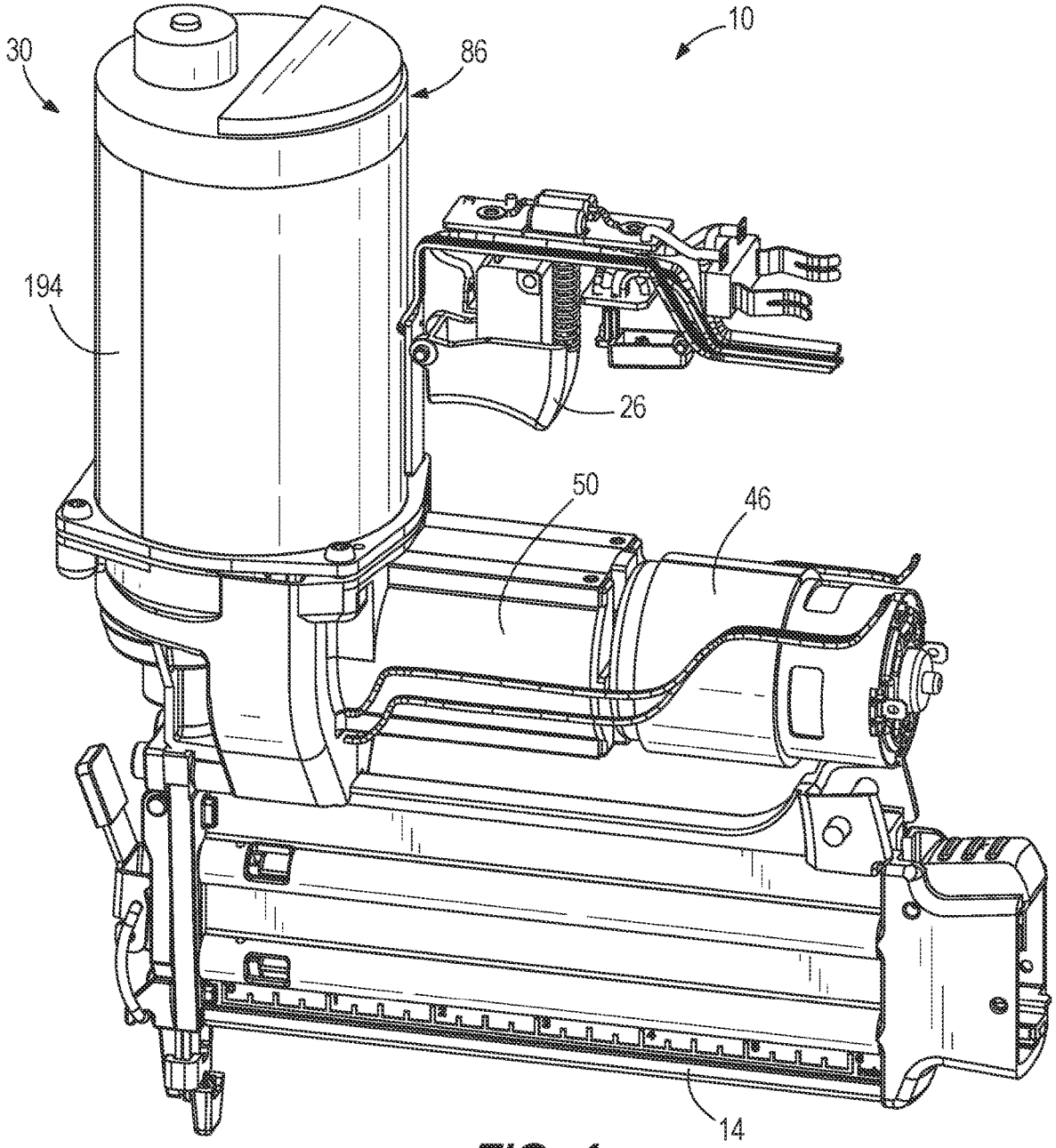
FIG. 1 is a perspective view of a powered fastener driver in accordance with an embodiment of the disclosure.

With reference to FIG. 1, a powered fastener driver 10 is operable to drive fasteners (e.g., nails, tacks, staples, etc.) held within a magazine 14 into a workpiece. The powered fastener driver 10 includes an outer housing with a handle portion, and a user-actuated trigger 26 mounted on the handle portion. Notably, the powered fastener driver 10 does not require an external source of air pressure, but rather the powered fastener driver 10 includes an on-board air compressor 30. In this way, the weight and/or size of tool may be reduced. The on-board air compressor 30 is powered by a power source (e.g., a battery pack), coupled to a battery attachment portion of the outer housing.

Figure 2:
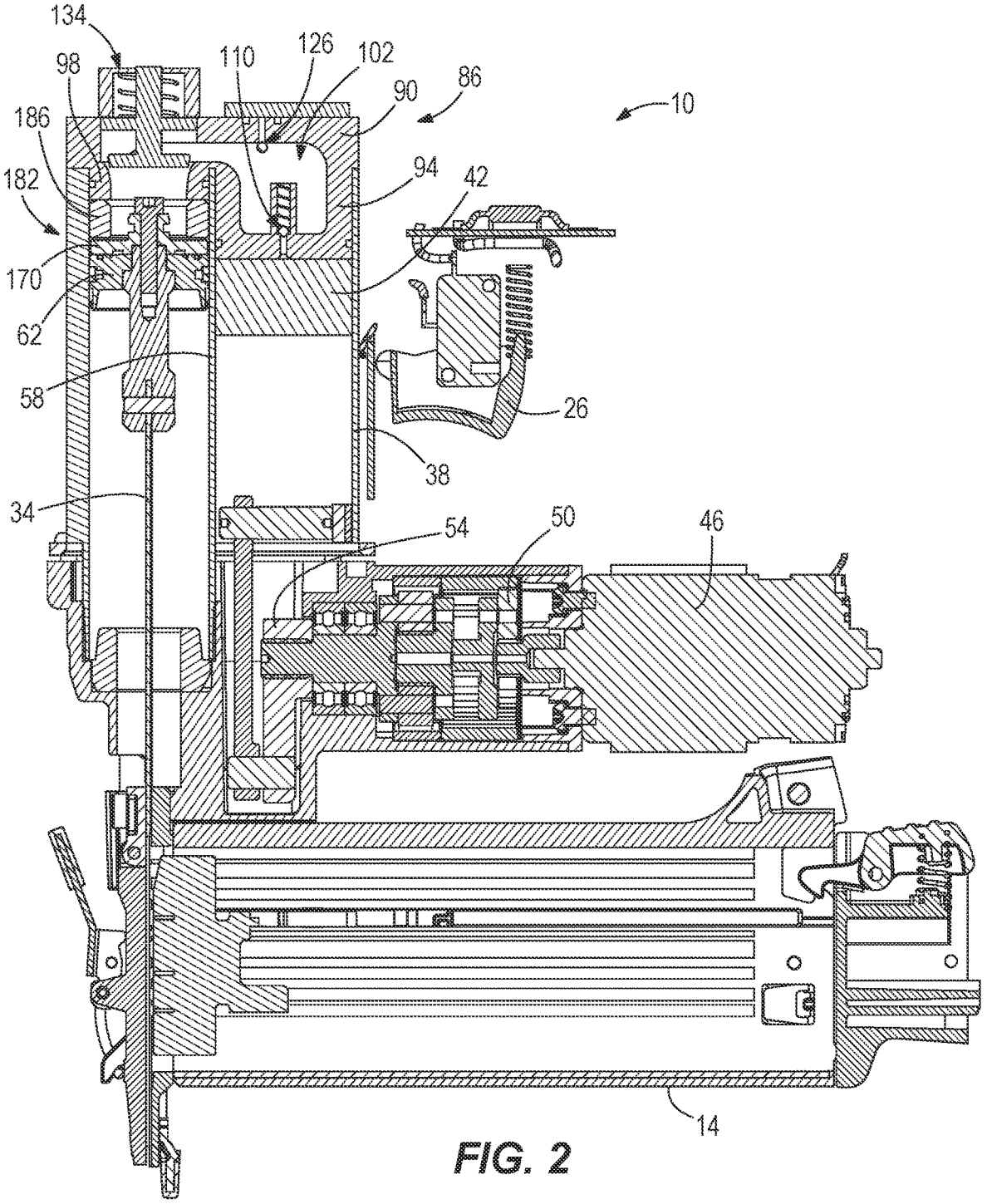
FIG. 2 is a cross-sectional view of the powered fastener driver of FIG. 1 taken along line 2-2 in FIG. 1.
Figure 8A:
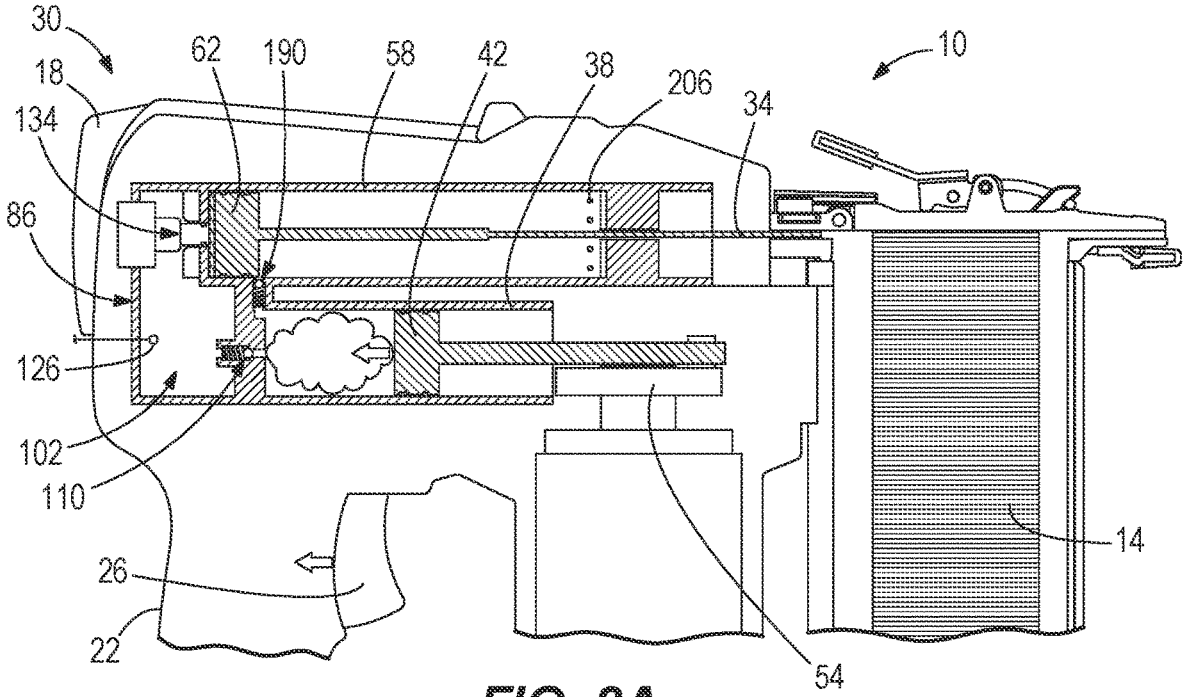
FIG. 8A is a schematic view of the powered fastener driver of FIG. 1, illustrating the start of an operation cycle.

With reference to FIGS. 1 and 2, the powered fastener driver 10 includes a drive blade 34 actuated by the on-board air compressor 30 to drive the fasteners into a workpiece. The compressor 30 includes a compressor cylinder 38 and a compressor piston 42 in the compressor cylinder 38 driven in a reciprocating manner by a reciprocating mechanism including a motor 46, a transmission 50, and a crank arm assembly 54. The powered fastener driver 10 also includes a drive cylinder 58 and a drive piston 62 slidably disposed in the drive cylinder 58. The drive piston 62 is movable between a top-dead-center position (FIG. 8A) and a bottom-dead-center position (FIG. 8H). Similarly, the compressor piston 42 is moveable between a top-dead-center position (FIG. 8B) and a bottom-dead-center position (FIG. 8A).

Figure 4:
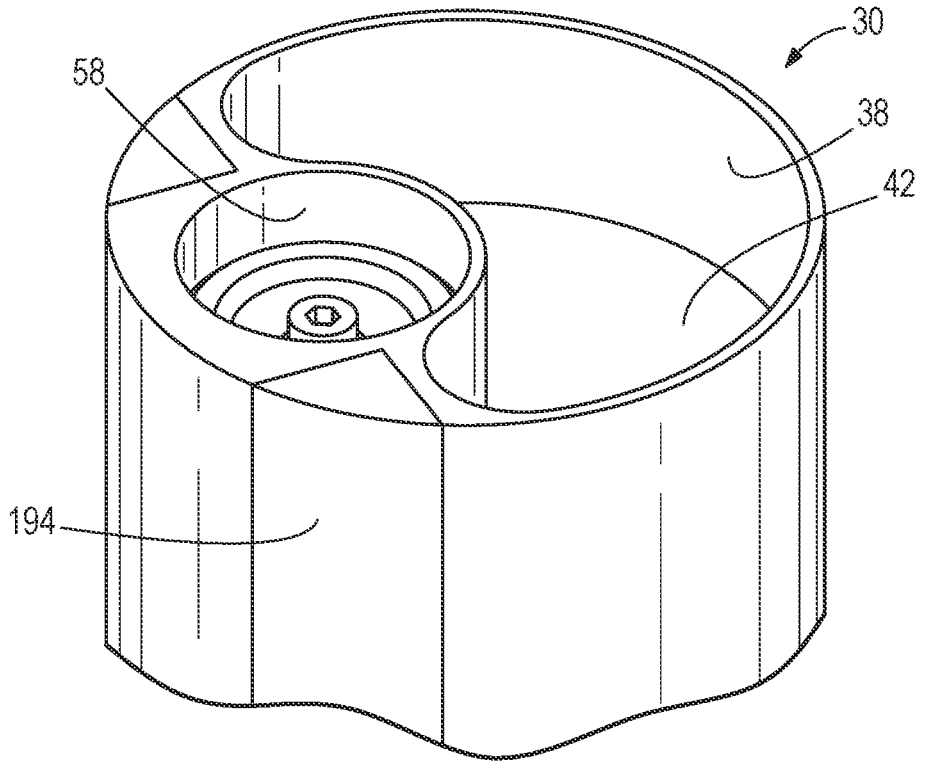
FIG. 4 is a perspective view of the powered fastener driver of FIG. 1, with a head assembly removed to illustrate a compressor piston and a drive piston.
Figure 5:
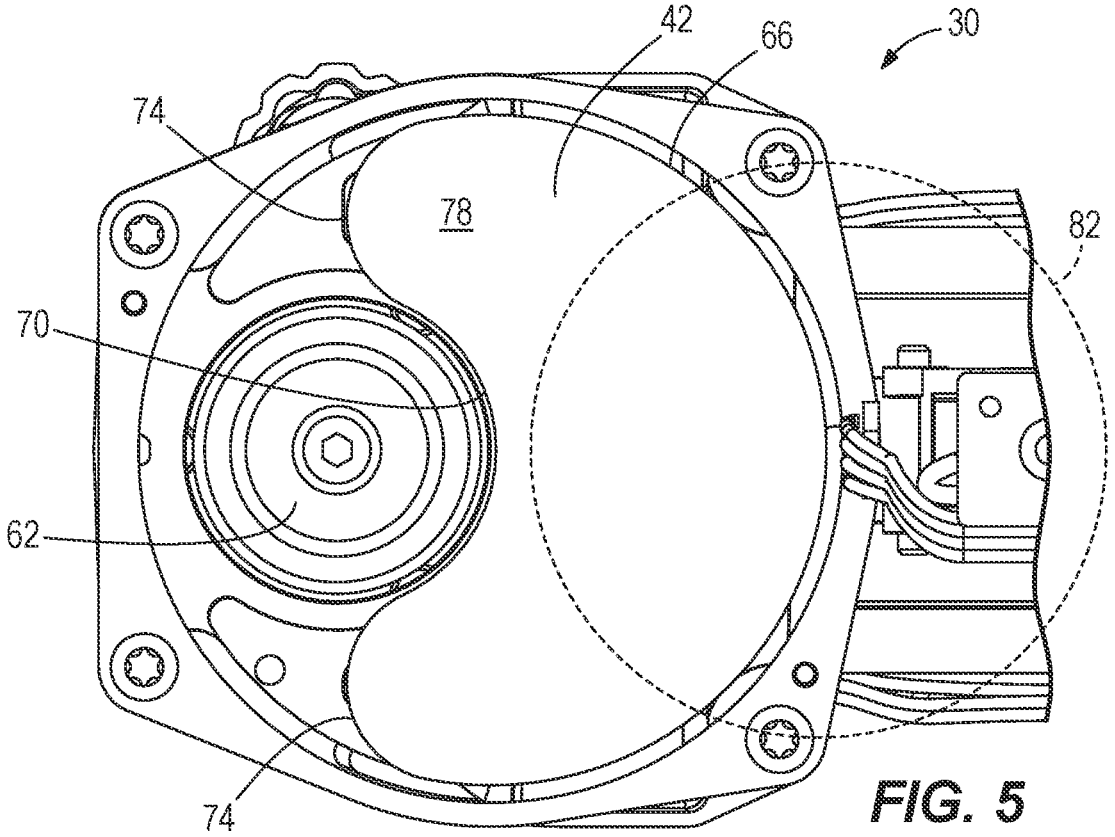
FIG. 5 is a top view of the of the powered fastener driver of FIG. 1, illustrating the compressor piston and the drive piston.

As shown in FIGS. 2 and 4, the smaller drive cylinder 58 at least partially extends into the larger compressor cylinder 38. However, the compressor piston 42 does not surround the entire drive cylinder 58. Instead, the compressor piston 42 is kidney-shaped (i.e., bean-shaped) and only partially wraps around the drive cylinder 58. The compressor piston 42, therefore, has a different shape than the drive piston 62. In other words, the compressor piston 42 is not circular, but rather is non-circularly shaped. In particular, the compressor piston 42 includes an outer convex surface 66, an inner concave surface 70, and rounded ends 74 connecting the outer surface 66 with the inner surface 70 (FIG. 5). In this way, the size and/or weight of the fastener driver 10 may be advantageously reduced for improved handling, manufacturability, and/or the like. For example, the compressor piston 42 defines a surface area 78, and if an equivalent surface area was reconfigured as a traditional circular piston, illustrated as a dashed circle 82 in FIG. 5, the size of the tool would be increased. By partially nesting and/or wrapping the compressor piston 42 around the drive cylinder 58, the overall size of the on-board compressor 30, and thus the fastener driver 10, is reduced. In some embodiments, the volume compressed by a single stroke of the compression piston 42 is approximately 6.5 cubic inches and achieves a compression ratio of approximately 5.3.1 per stroke.

Figure 3:
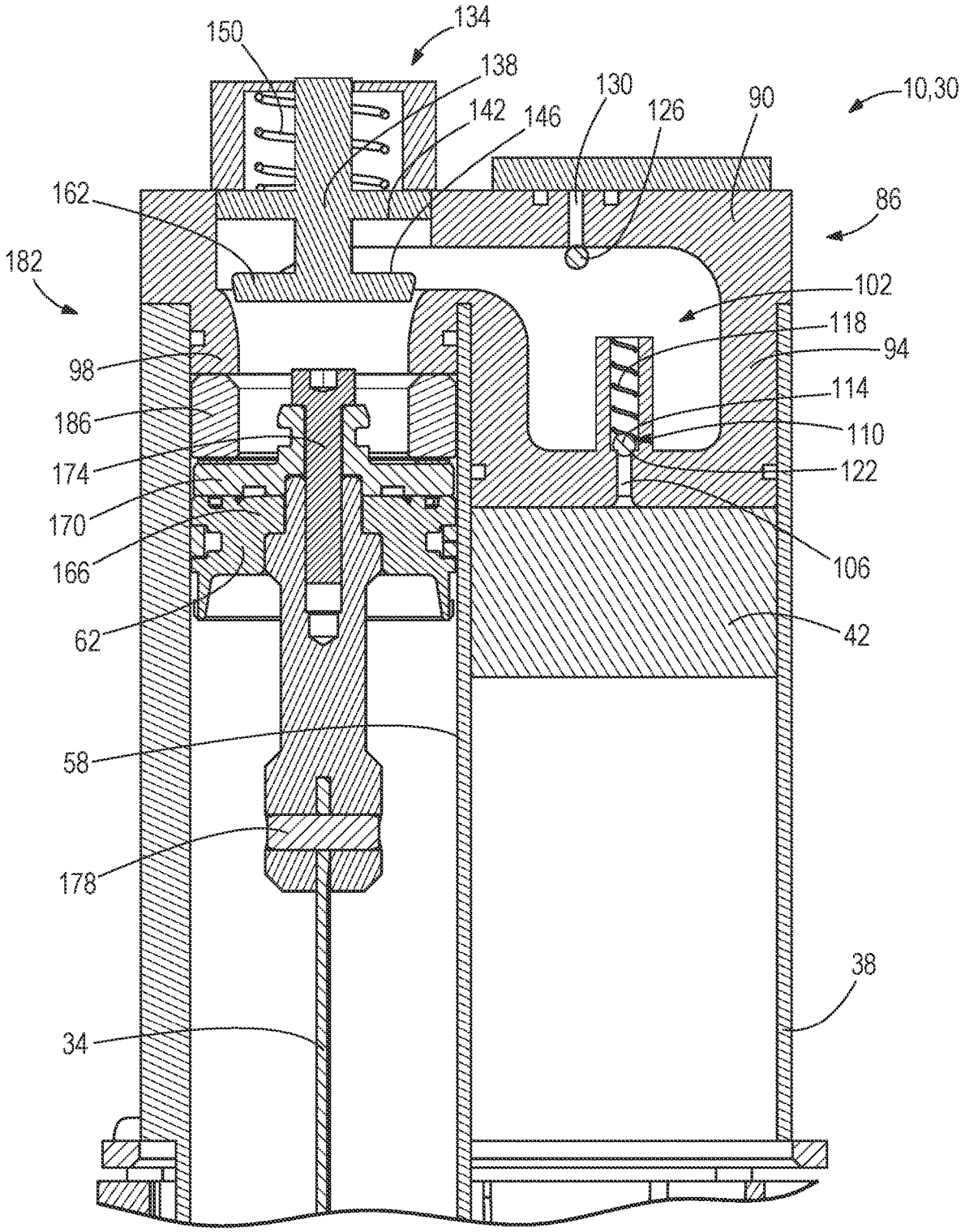
FIG. 3 is an enlarged, partial cross-sectional view of the powered fastener driver of FIG. 2.

With reference to FIG. 3, the on-board air compressor 30 includes a head assembly 86 positioned at a top end 90 of the cylinders 38, 58. The head assembly 86 includes an end cap 90, a first portion 94 of which is positioned within the compressor cylinder 38 and a second portion 98 of which is positioned within the drive cylinder 58. A pressure storage chamber 102 is formed within the head assembly 86. As explained in greater detail below, the pressure storage chamber 102 is capable of fluidly communicating with the compressor cylinder 38 and the drive cylinder 58. The first portion 94 of the head assembly 86 includes a first passageway 106 that fluidly communicates the compressor cylinder 38 and the pressure storage chamber 102.

A first check valve 110 is positioned within the first passageway 106 between the compressor cylinder 38 and the pressure storage chamber 102. The first check valve 110 is a one-way valve that permits air to flow into the pressure storage chamber 102 from the compressor cylinder 38, but does not permit air to flow into the compressor cylinder 38 from the pressure storage chamber 102. In the illustrated embodiment, the first check valve 110 includes a ball 114 that is biased by a compression spring 118 into a seat 122 around the first passageway 106. As explained in greater detail below, compressed air created by the compressor piston 42 unseats the ball 114 from the seat 122 and flows into the pressure storage chamber 102. During other times, the spring 118 biases the ball 114 into the seat 122 to seal the pressure storage chamber 102 from the compressor cylinder 38.

A pressure sensor 126 is partially positioned within the pressure storage chamber 102 and is configured to detect a pressure level within the pressure storage chamber 102. The pressure sensor 126 is electrically coupled to a control system (i.e., a controller). In some embodiments, the pressure detected within the pressure storage chamber 102 by the pressure sensor 126 is utilized by the controller to determine when to de-energize the motor 46. In other embodiments, the pressure detected within the pressure storage chamber 102 by the pressure sensor 126 is utilized by the controller to determine when to energize a solenoid-actuated pressure valve that communicates the pressure storage chamber 102 with the drive cylinder 58. In the illustrated embodiment, the head assembly 86 includes a passageway 130 in which to receive a portion of the pressure sensor 126. The passageway 130 extends between the pressure storage chamber 102 and the exterior of the head assembly 86.

A pressure valve 134 (i.e., a pressure release valve, a firing valve, and/or the like) is positioned within the head assembly 86 and selectively fluidly communicates the pressure storage chamber 102 with the drive cylinder 58. The pressure valve 134 may be an electrically actuated valve or a pressure-actuated valve (i.e., a valve that is responsive to external forces applied by the compressed air in the pressure storage chamber 102). The pressure valve 134 remains in a closed position (FIG. 7A) as the pressure within the pressure storage chamber 102 increases. Upon reaching a threshold pressure value within the pressure storage chamber 102, the pressure valve 134 moves to an open position (FIG. 7B). When the pressure valve 134 is in the open position, the pressure within the pressure storage chamber 102 is fluidly communicated to the drive cylinder 58. As described in further detail below, when the pressure valve 134 opens, the pressure within the pressure storage chamber 102 moves the drive piston 62 toward a bottom-dead-center position causing a fastener to be driven into a workpiece by the driver blade 34.

Figure 7A:
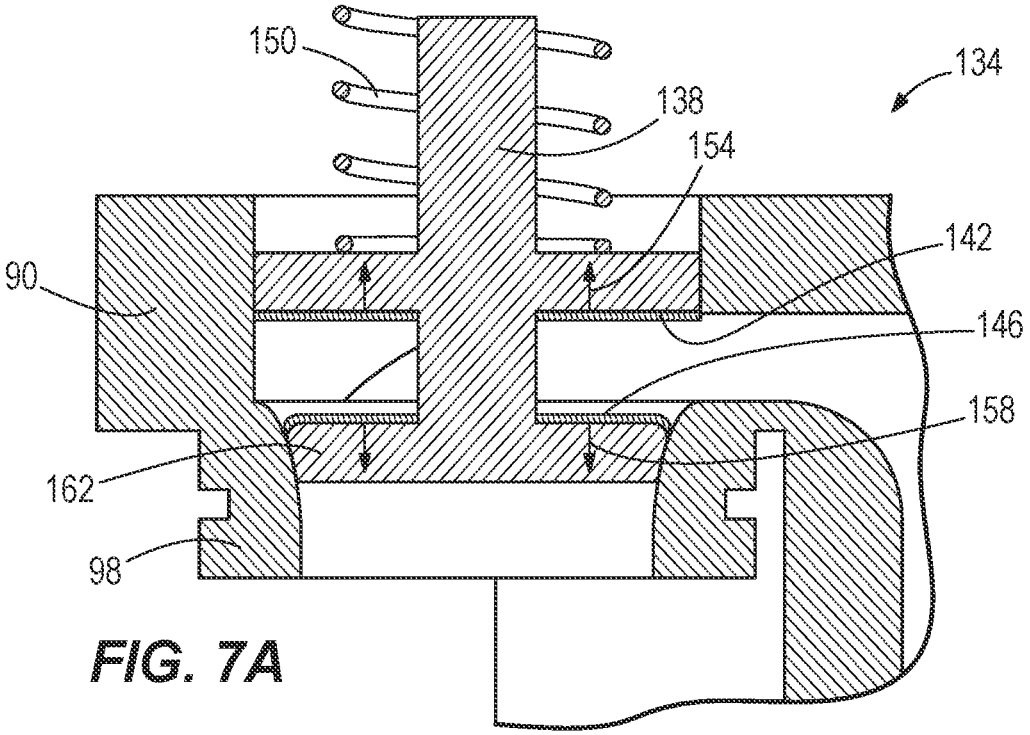
FIG. 7A is a cross-sectional view of a mechanical pressure valve of the powered fastener driver of FIG. 1, illustrating the mechanical pressure valve in a closed position.
Figure 7B:
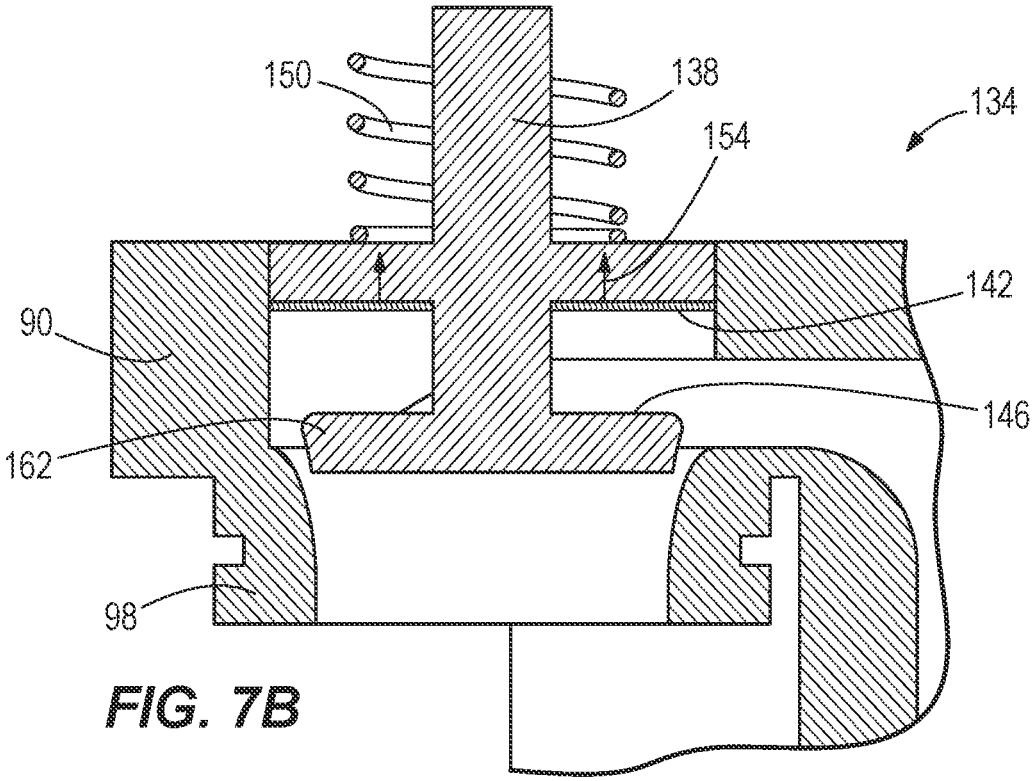
FIG. 7B is a cross-sectional view of the mechanical pressure valve of FIG. 7A, illustrating the mechanical pressure valve in an open position.

With references to FIGS. 7A and 7B, the pressure valve 134 is illustrated as a pressure-actuated release valve. The pressure valve 134 includes a plunger 138 with a first surface 142 and a second surface 146. The first surface 142 is opposite of (i.e., in facing relationship to) the second surface 146. In the illustrated embodiment, the first surface 142 is larger than the second surface 146. The first surface 142 and the second surface 146 are in fluid communication with the pressure storage chamber 102. In some embodiments, the first surface 142 and the second surface 146 partially define the pressure storage chamber 102. A spring 150 biases the plunger 138 into a first position (FIG. 7A) in which the pressure storage chamber 102 is sealed from the drive cylinder 58 by a sealing plate 162.

When the pressure within the pressure storage chamber 102 reaches a threshold pressure value (i.e., a firing pressure), the plunger 138 is caused to automatically move to a second position (FIG. 7B) in which the pressure storage chamber 102 is fluidly communicated with the drive cylinder 58. More specifically, when the pressure in the pressure storage chamber 102 is at or below the threshold, a force 154 acting upward (as viewed in FIG. 7A) on the first surface 142 and a force 158 acting downward (as viewed in FIG. 7A) on the second surface 146 are approximately the same and essentially cancel each other out. As a result of the approximately equal forces 154, 158, the bias force of the spring 150 keeps the plunger 138 in the closed position. Once the pressure within the pressure storage chamber 102 reaches the threshold pressure value, the force 154 acting on the first surface 142 is much larger than the force 158 acting on the second surface 146. In other words, the first surface 142 is larger than the second surface 146 so the force acting on the first surface 142 is larger when both surfaces 142, 146 are acted upon by the threshold pressure value. The difference in force acting on the first surface 142 and the force acting on the second surface 146 causes the plunger 138 to move (e.g., slide, translate, and/or the like) against the bias of the spring 150 into the open position (FIG. 7B). As the plunger 138 is lifted from the seated, closed position, the pressure from the pressure storage chamber 102 surrounds the sealing plate 162 of the plunger 138 so that the pressure is no longer creating a net force acting on the second surface 146. As such, the plunger 138 will quickly move to the open position once the bottom sealing plate 162 of the plunger 138 has been unseated. The plunger 138 may remain in the open position until the pressure drops and the spring 150 biases the plunger 138 back into the seated, closed position.

In some embodiments, the threshold pressure value at which the pressure valve 134 moves from the closed position (FIG. 7A) to the open position (FIG. 7B) can be adjusted or controlled by the design of the difference in surface area of the first surface 142 and the second surface 146, and with the stiffness of the spring 150. In this way, the amount of pressure acting on the drive piston 62 may be increased or decreased for driving different sizes of fasteners (e.g., 16 gauge nails, 18 gauge nails, and/or the like) to appropriate distances within a workpiece. In this way, the fastener driver 10 may be suitable for use in a variety of different fastening applications. For example, with a given spring a plunger with a first surface that is two times the size of the second surface will move to an open position at a lower threshold pressure value than a plunger with a surface 1.5 times the size of the second surface. Likewise, with a given plunger, a stiffer spring will cause the plunger to move open at a higher threshold pressure value.

In other embodiments, the pressure valve is an electronically controlled solenoid valve that is actuated between an open position (fluidly communicating the drive cylinder 58 with the pressure storage chamber 102) and a closed position (sealing the drive cylinder 58 from the pressure storage chamber 102). In some embodiments, the first surface 142 of the plunger is equal to the second surface 146, and the plunger is actuated by the electrical actuator. The output from the pressure sensor 126 is utilized by the controller to determine when to actuate the solenoid and open the pressure valve.

With reference to FIG. 3, the drive piston 62 includes a body 166 and a ferromagnetic cap 170 is secured to the body 166 by a threaded fastener 174. The drive blade 34 may be attached to the main body 166 of the drive piston 62 by a pin 178 interference-fit to the main body 166. A magnetic latch 182 may be capable of holding the drive piston 62 in the top-dead-center position by way of a magnetic force. The latch 182 may include an annular magnet 186 positioned near the top of the drive cylinder 58. The annular magnet 186 may emit a magnetic field that magnetically attracts the ferromagnetic cap 170, which is also a part of the magnetic latch 182. Alternatively, the magnetic latch 182 could include a ferromagnetic portion positioned near the top of the drive cylinder 58 and a magnet secured to the drive piston 62.

Figure 6:
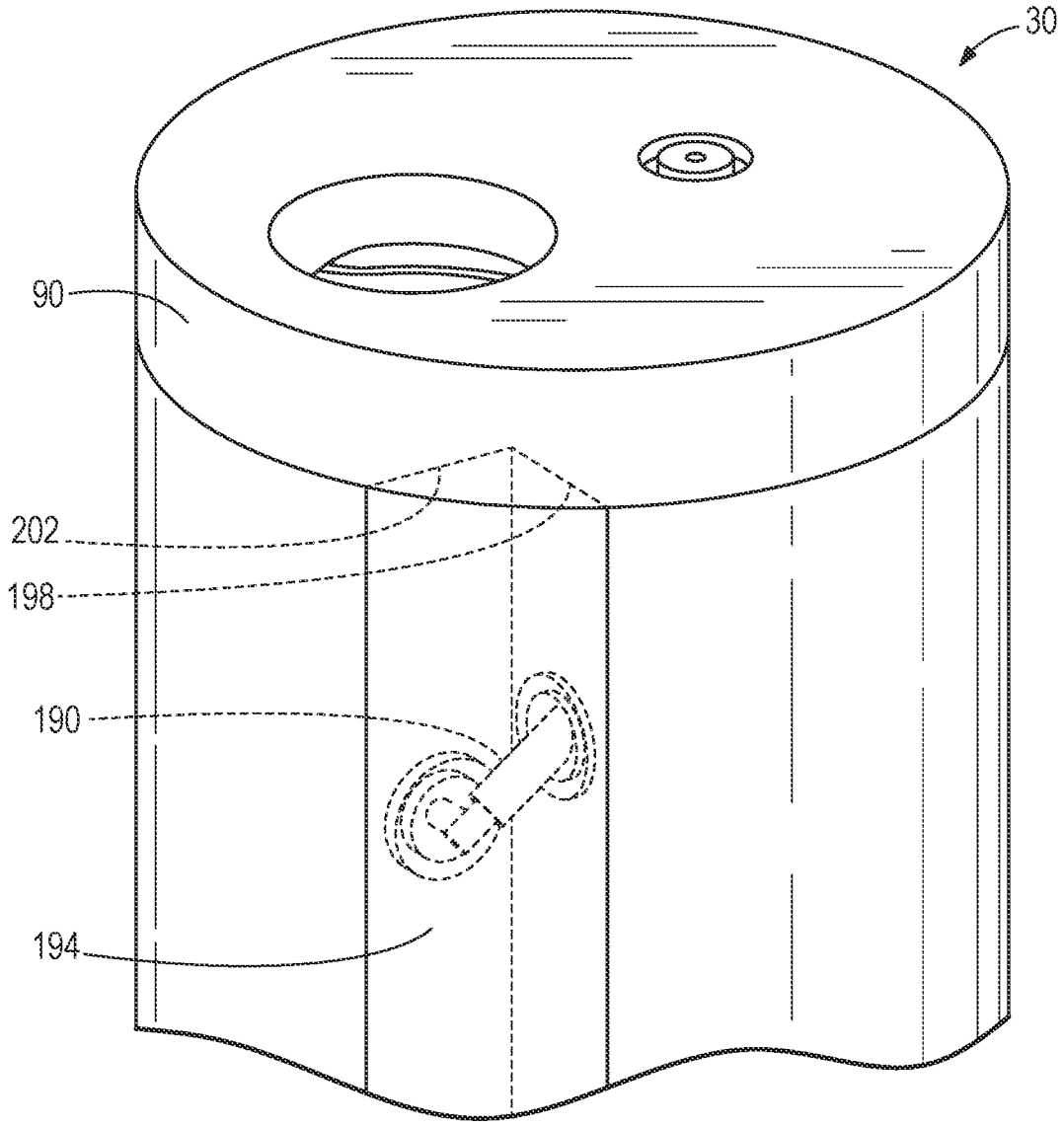
FIG. 6 is a partial perspective view of the powered fastener driver of FIG. 1, illustrating a valve in fluid communication with a drive cylinder and a compressor cylinder.

With reference to FIG. 6, a second check valve 190 may be positioned within a cutout 194 formed between a sidewall 198 of the compressor cylinder 38 and a sidewall 202 of the drive cylinder 58. The second check valve 190 may be a one-way valve the permits air to flow into the compressor cylinder 38 from the drive cylinder 62, but does not permit air to flow into the drive cylinder 58 from the compressor cylinder 38. In the illustrated embodiment, the second check valve 190 is a spring-biased ball valve like the first check valve 110 described above. As explained in greater detail below, air is drawn into the compressor cylinder 38 through the second check valve 190 as the compressor piston 42 retracts towards the bottom-dead-center position. Holes 206 (i.e., vents, apertures, openings, and/or the like; FIGS. 8A-8L) are formed in the bottom of the drive cylinder 58 and permit atmosphere to enter the drive cylinder 58.

Figure 8B:
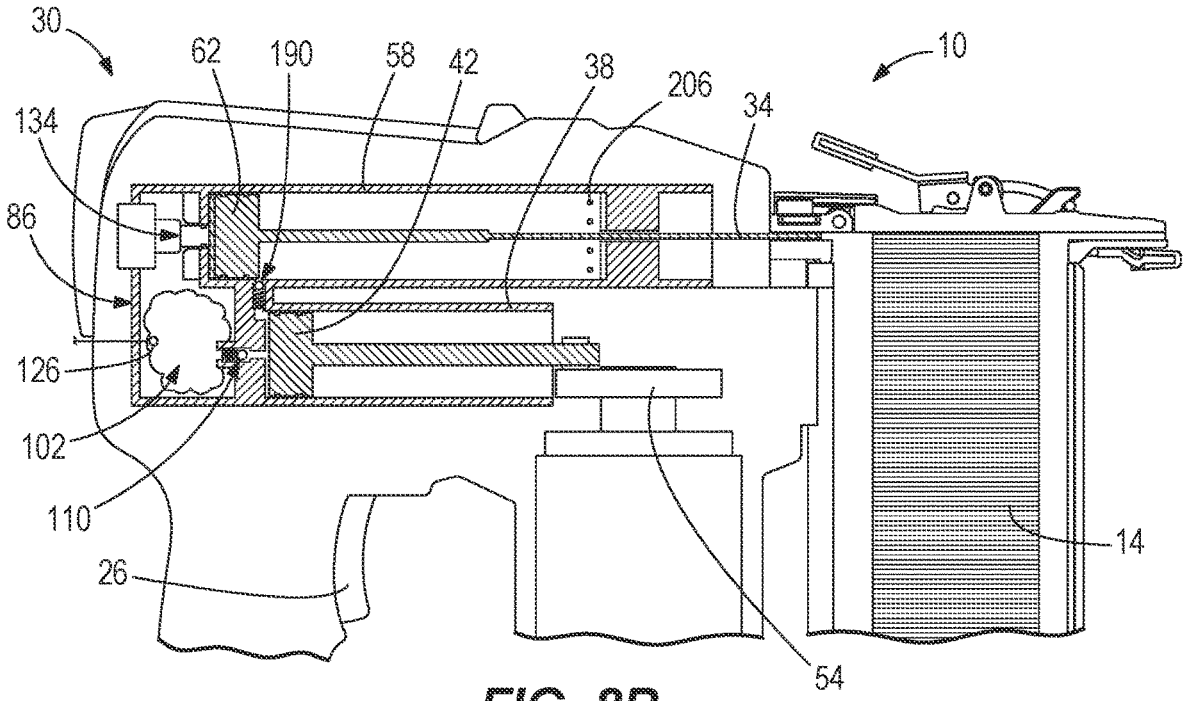
FIG. 8B is a schematic view of the powered fastener driver of FIG. 8A, illustrating a first compression stroke of a compressor piston.
Figure 8C:
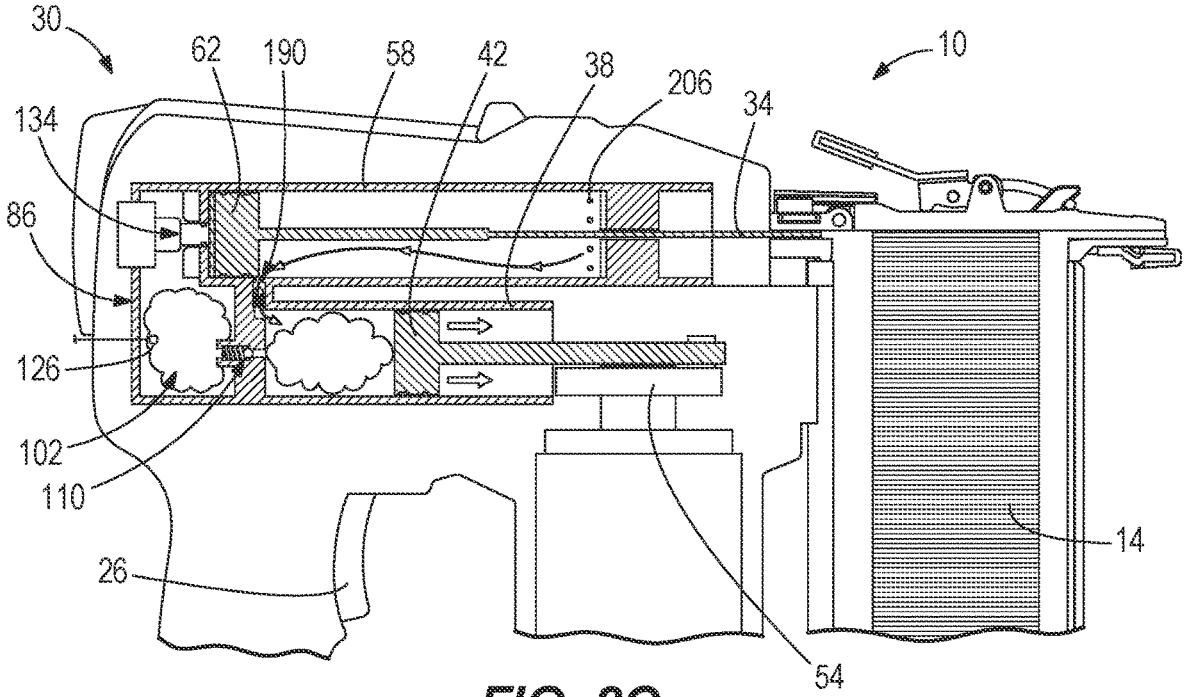
FIG. 8C is a schematic view of the powered fastener driver of FIG. 8A, illustrating a first retraction stroke of the compressor piston.
Figure 8D:
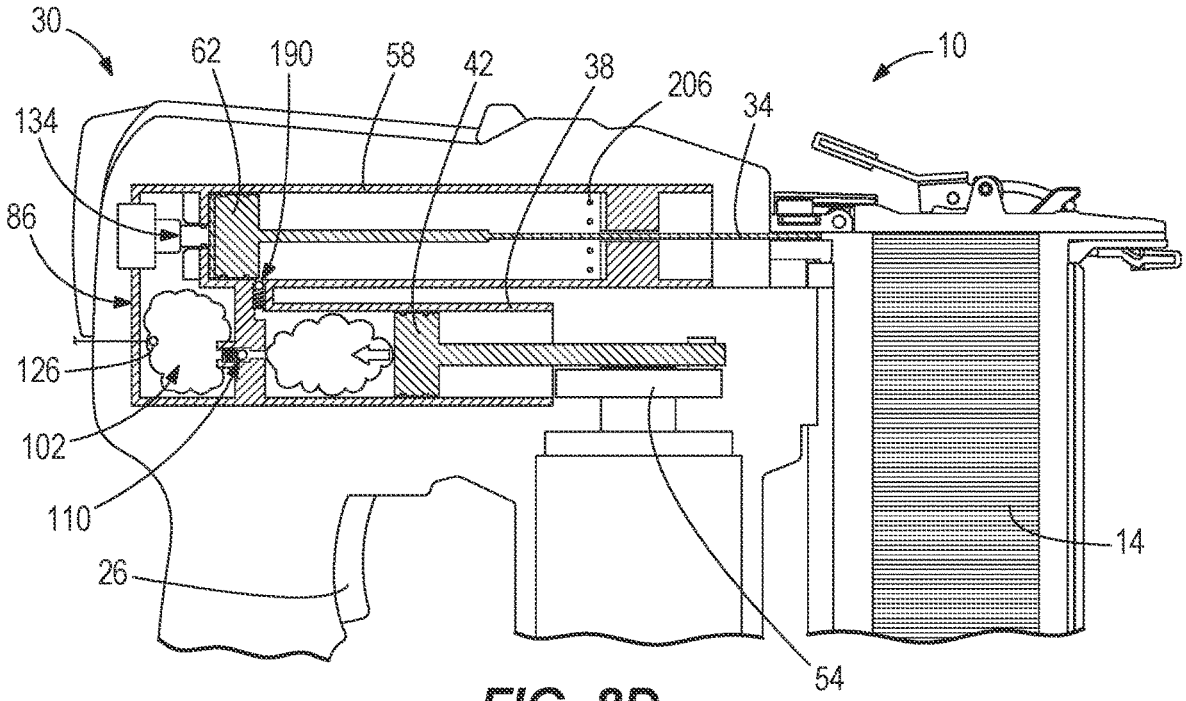
FIG. 8D is a schematic view of the powered fastener driver of FIG. 8A, illustrating a second compression stroke of the compressor piston.
Figure 8E:
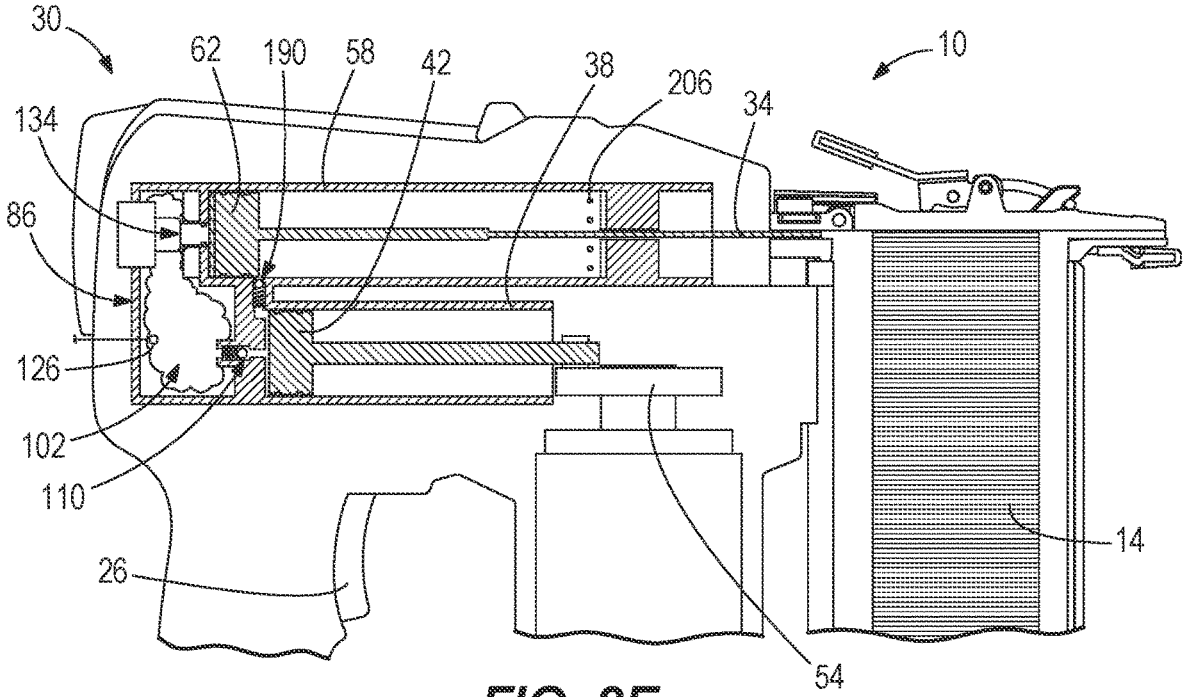
FIG. 8E is a schematic view of the powered fastener driver of FIG. 8A, illustrating the completion of the second compression stroke of the compressor piston.
Figure 8F:
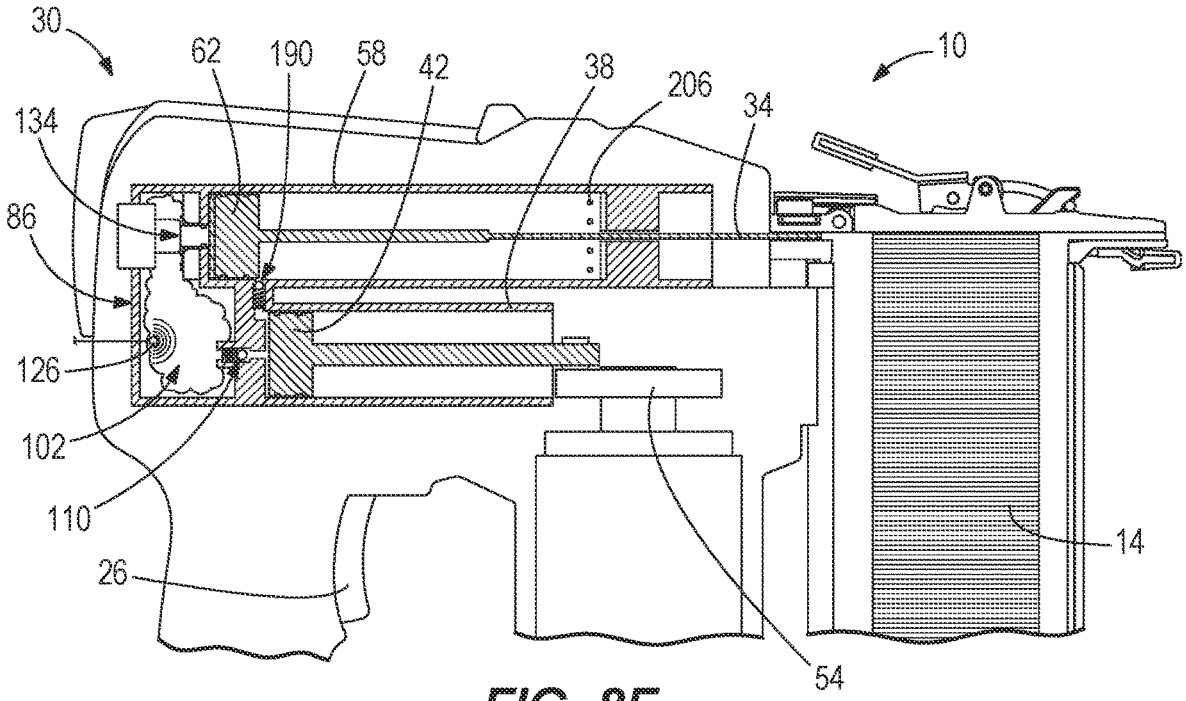
FIG. 8F is a schematic view of the powered fastener driver of FIG. 8A, illustrating a sensor detecting a threshold pressure level present in a storage chamber.
Figure 8G:
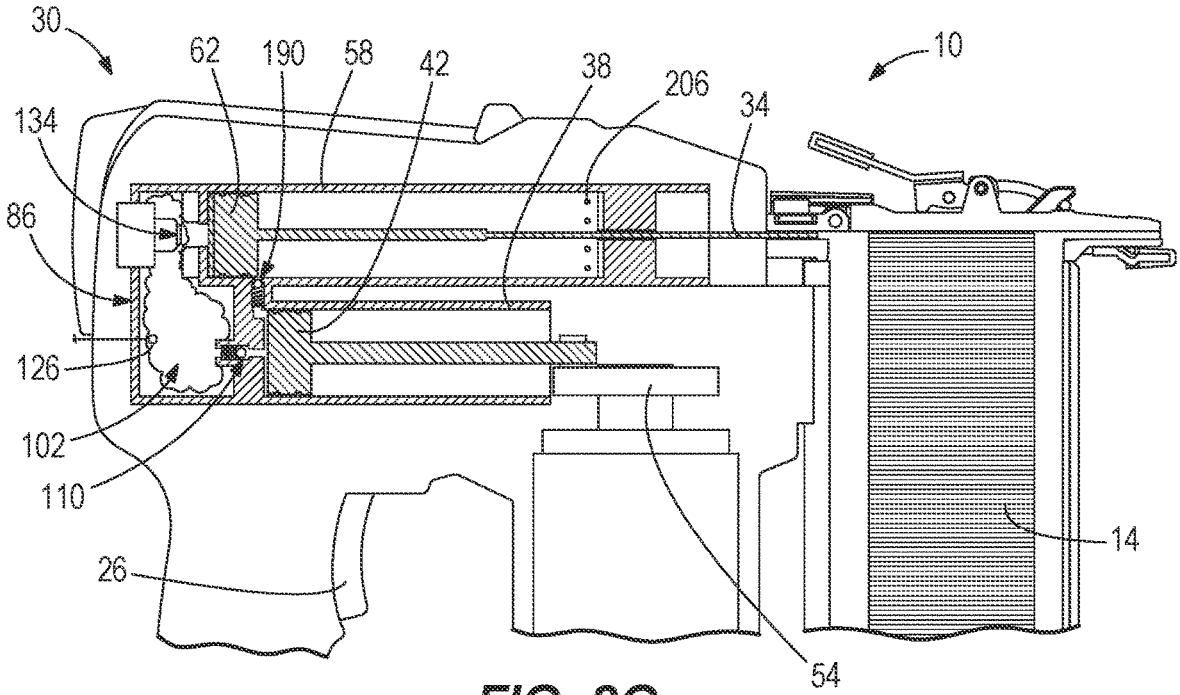
FIG. 8G is a schematic view of the powered fastener driver of FIG. 8A, illustrating a pressure valve in an open position.
Figure 8H:
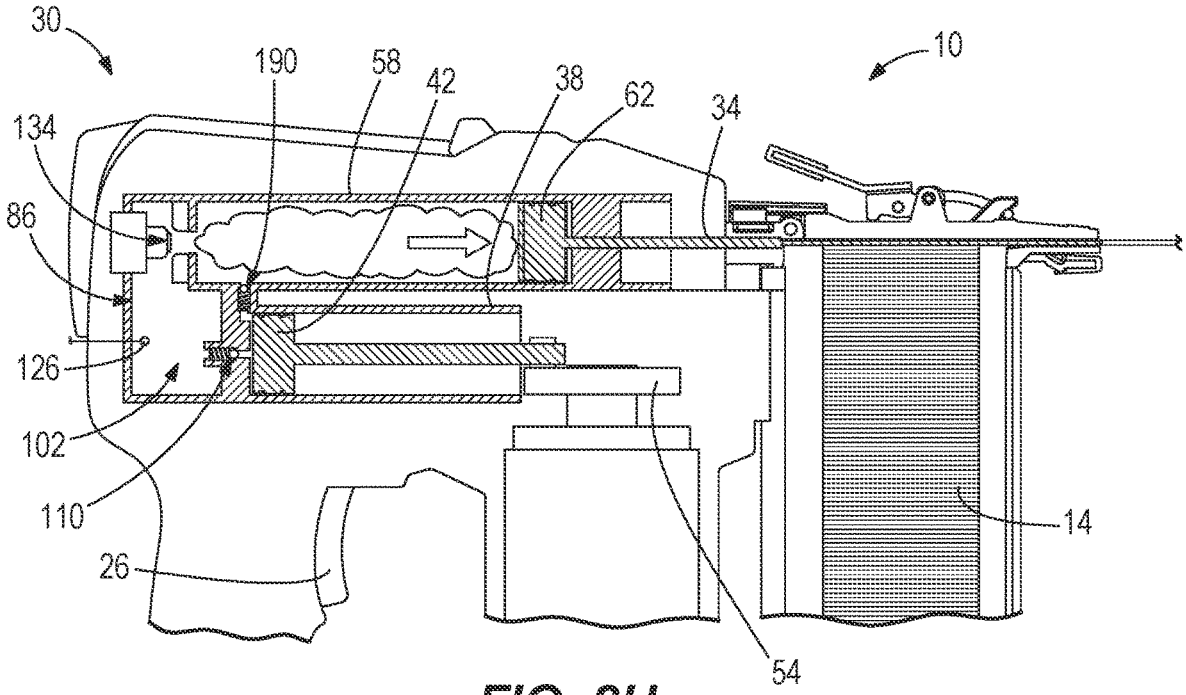
FIG. 8H is a schematic view of the powered fastener driver of FIG. 8A, illustrating a drive stroke of a drive piston.

With reference to FIGS. 8A-8L, a fastener driving operation (i.e., a drive cycle, an operation cycle, and/or the like) of the powered fastener driver 10 is illustrated. With reference to FIG. 8A, at the beginning of the operation cycle, the magnetic latch 182 maintains the drive piston 62 in the top-dead-center position, while the compressor piston 42 is in the bottom-dead-center position. When the user of the driver 10 depresses the trigger 26 (FIG. 8A), the compressor piston 42 is driven upward and toward the top end of the compressor cylinder 38 by the motor 46 and crank arm assembly 54 (FIG. 8B). As the compressor piston 42 travels upward, the air in the compressor cylinder 38 and above the compressor piston 42 is compressed. The compressed air in the compressor cylinder 38 passes through the first check valve 110 and enters the pressure storage chamber 102. After the compression piston 42 completes a first compression stroke, the pressure within the pressure storage chamber 102 may remain below the threshold pressure value for initiating a firing operation, and therefore, the drive piston 62 remains in the top-dead-center position. In other words, more than one compression stroke (i.e., multiple compression strokes) is required to achieve the threshold pressure value within the pressure storage chamber 102.

With reference to FIG. 8C, the compressor piston 42 is driven through a first retraction stroke. Atmospheric air from the holes 206 is drawn into the compressor cylinder 38 through the second check valve 190. With reference to FIG. 8D, the compressor piston 42 is driven through a second compression stroke, again compressing the air within the compressor cylinder 38. With reference to FIG. 8E, the compressed air within the compressor cylinder 38 moves through the first check valve 110 and continues to build the pressure within the pressure storage chamber 102.

With reference to FIG. 8F, the pressure sensor 126 detects the pressure within the pressure storage chamber 102 satisfied (e.g., reached, and/or the like) the threshold pressure value, which may be achieved after two or more compression strokes of the compressor piston 42. With reference to FIG. 8G, upon reaching or satisfying the pressure threshold value, the pressure valve 134 is moved to an open position. As discussed above, the pressure valve 134 in the illustrated embodiment is a pressure-actuated valve that opens automatically in response to the threshold pressure value being reached. Alternatively, the pressure valve 134 may be electronically controlled to be actuated to the open position in response to the pressure detected by the pressure sensor 126.

Figure 8I:
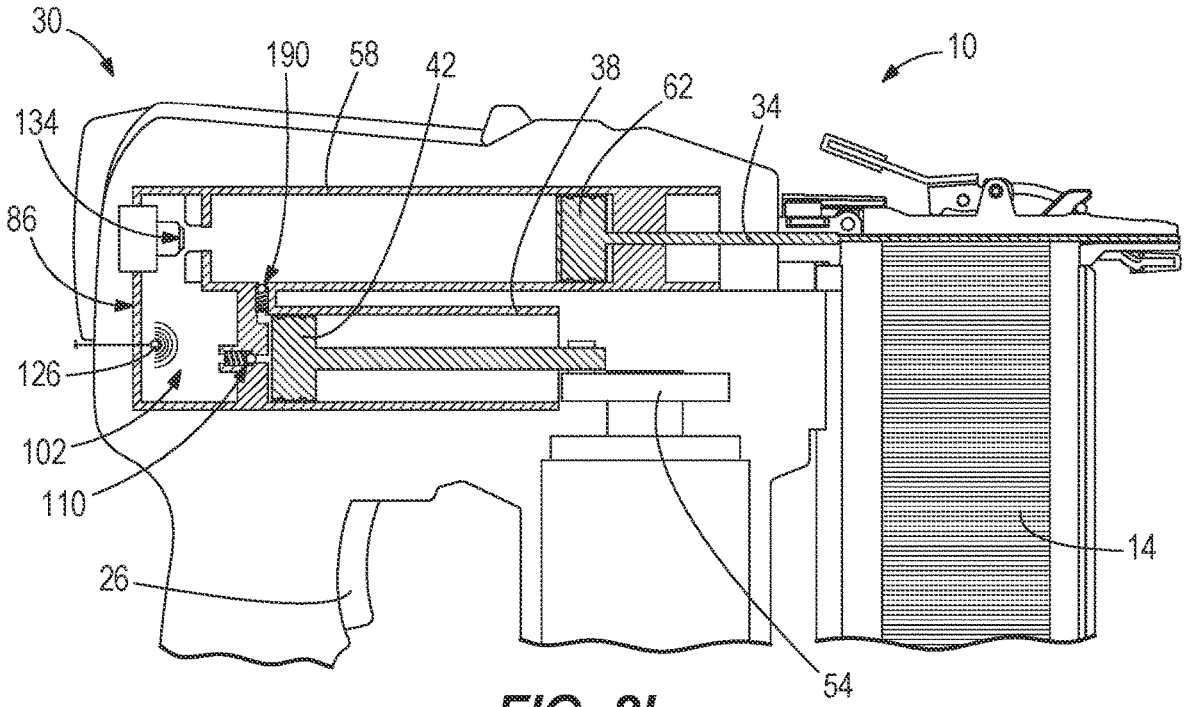
FIG. 8I is a schematic view of the powered fastener driver of FIG. 8A, illustrating a completion of the drive stroke of the drive piston.
Figure 8J:
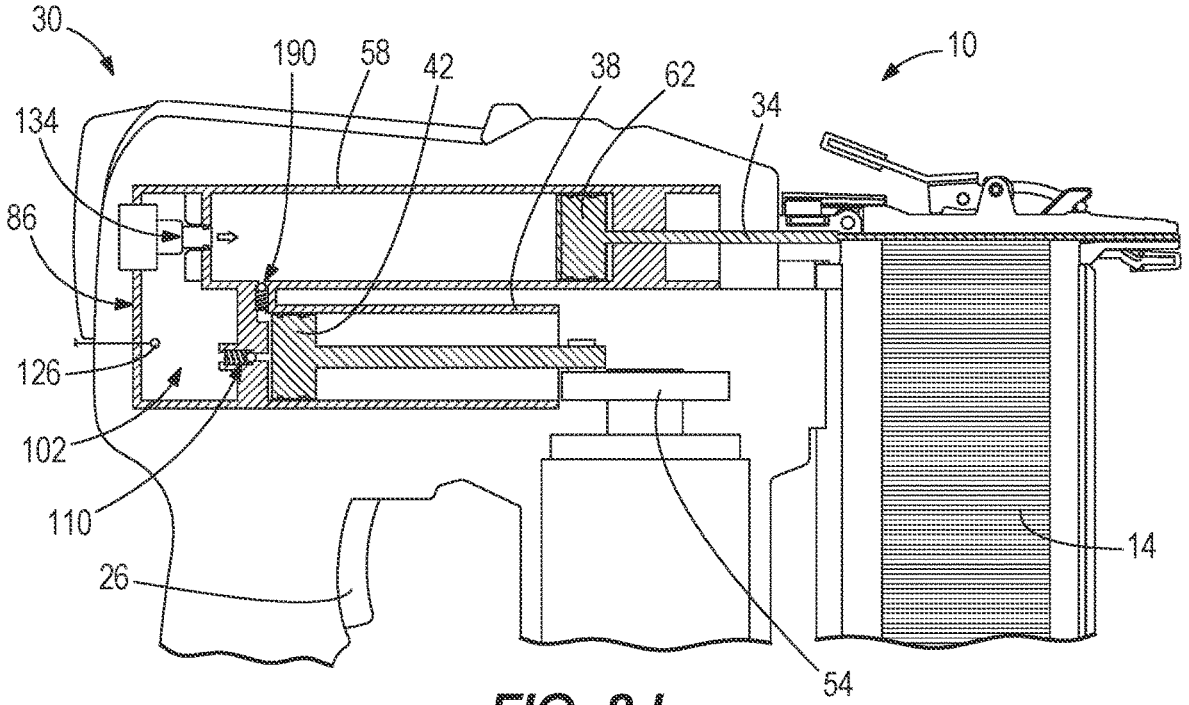
FIG. 8J is a schematic view of the powered fastener driver of FIG. 8A, illustrating the completion of the drive stroke of the drive piston and the pressure valve in a closed position.

With reference to FIG. 8H, with the pressure valve 134 in the open position, the compressed air within the pressure storage chamber 102 rushes into the drive cylinder 58. The force of the compressed air acting on the drive piston 62 overcomes the magnetic force of the magnetic latch 182 acting on the drive piston 62, and the drive piston 62 is accelerated downward within the drive cylinder 58 by the compressed air. As the drive piston 62 is driven downwards, the drive blade 34 impacts a fastener held in the magazine 14 and drives the fastener into a workpiece until the drive piston 62 reaches the bottom-dead-center position (FIG. 8I). Once the drive piston 62 reaches bottom-dead-center, the pressure valve 134 is moved back into the closed position (FIG. 8J).

Figure 8K:
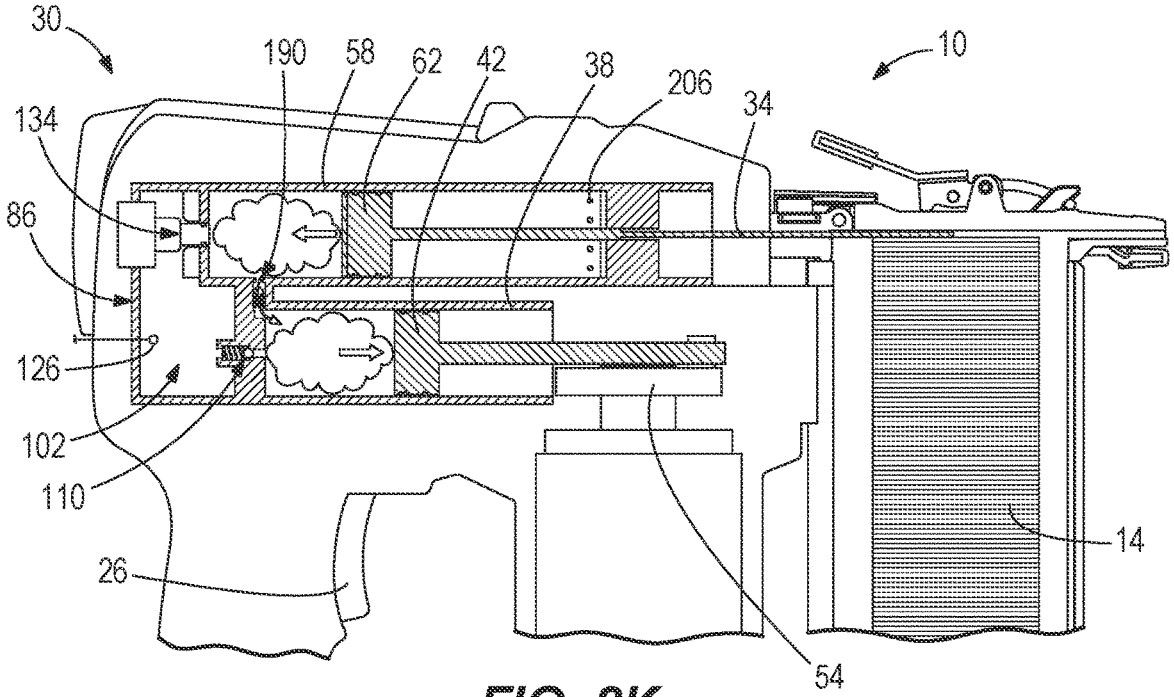
FIG. 8K is a schematic view of the powered fastener driver of FIG. 8A, illustrating a second retraction stroke of the compressor piston and a return stroke of the drive piston.
Figure 8L:
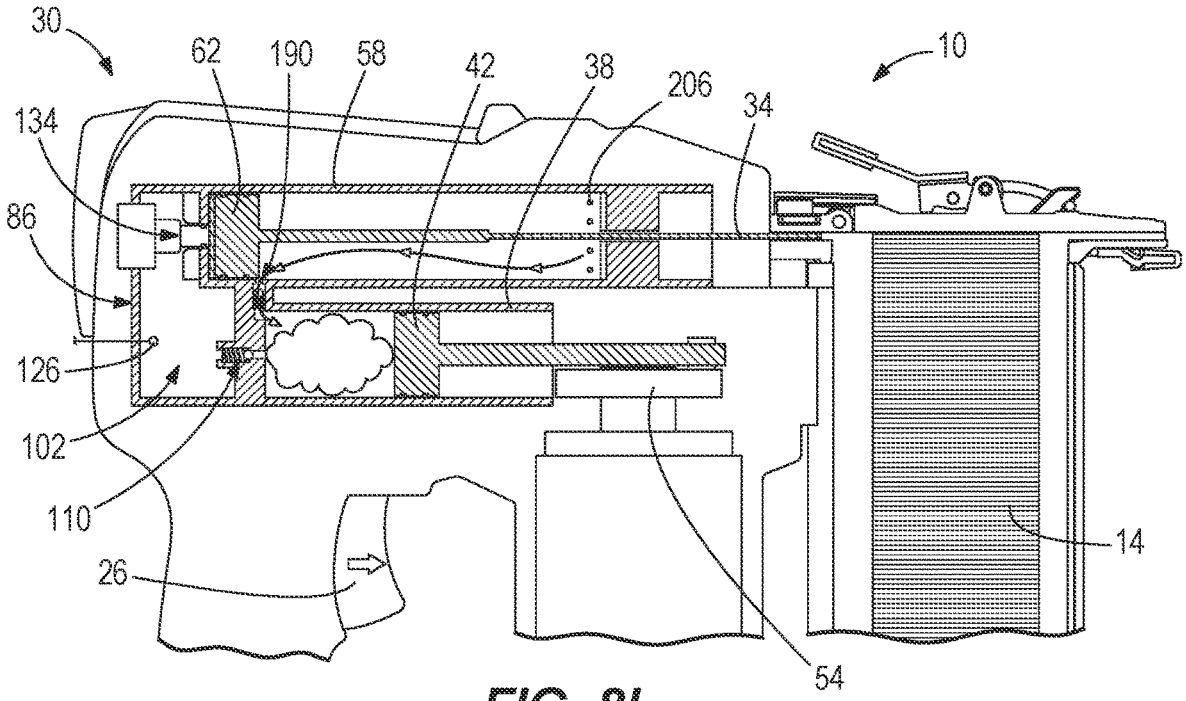
FIG. 8L is a schematic view of the powered fastener driver of FIG. 8A, illustrating a completion of the operation cycle.

With reference to FIG. 8K, to prepare for a subsequent fastener driving operation, the compressor piston 42 is driven downwards towards the bottom-dead-center position by the motor 46 and crank arm assembly 54. As the compressor piston 42 is driven through a retraction stroke, a vacuum is created within the compressor cylinder 38 and the drive cylinder 58. Specifically, the second check valve 190 allows the vacuum to be communicated to the drive cylinder 58 above the drive piston 62. The vacuum draws the drive piston 62 upwards in the drive cylinder 58 until the ferromagnetic cap 170 of the drive piston 62 reaches top-dead-center, after which time the magnetic latch 182 again holds or maintains the drive piston 62 in the top-dead-center position. With the drive piston 62 retained in the top-dead-center position, retraction of the compressor piston 42 continues to draw in atmospheric air from the holes 206 flowing through the second check valve 190 (FIG. 8L). At which point, the operation cycle has been completed and the fastener driver 10 is ready for the next operation cycle in response to user actuation of the trigger 26, for example (FIG. 8A).

Although the present subject matter has been described in detail with reference to certain preferred embodiments, variations and modifications exist within the scope of one or more independent aspects of the present subject matter as described.

Various features of the invention are set forth in the following claims.

What is claimed:

1. A powered fastener driver comprising:

a housing defining therein a first cylinder and a second cylinder;

a first piston positioned within the first cylinder, the first piston being moveable between a first top-dead-center position and a first bottom-dead-center position, the first piston having a non-circular shape;

a second piston positioned within the second cylinder, the second piston being moveable between a second top-dead-center position and a second bottom-dead-center position;

a cutout formed in the housing between the first and second cylinders and extending in a longitudinal direction; and a check valve positioned within the cutout and configured to allow air to flow from below the second piston to above the first piston.

2. The powered fastener driver of claim 1, wherein the first piston has a kidney-bean shape.

3. The powered fastener driver of claim 2, wherein the first piston is a compressor piston that is driven between the first top-dead-center position and the first bottom-dead-center position by a reciprocating mechanism.

4. The powered fastener driver of claim 1, wherein the second cylinder is in selective fluid communication with the first cylinder, and wherein a drive blade is coupled to the second piston for movement therewith.

5. The powered fastener driver of claim 1, wherein the second piston has a different shape than the first piston.

6. The powered fastener driver of claim 1, wherein the first piston only partially wraps around the second piston.

7. The powered fastener driver of claim 1, further comprising a reciprocating mechanism configured to drive the first piston between the first top-dead-center position and the first bottom-dead-center position, wherein the second piston is driven from the second top-dead-center position to the second bottom-dead-center position in response to the movement of the first piston.

8. The powered fastener driver of claim 1, further comprising:

a pressure storage chamber in selective fluid communication with the first cylinder, a pressure valve positioned between the pressure storage chamber and the second cylinder, wherein the pressure valve is configured to move from a closed position to an open position in response to the pressure within the pressure storage chamber reaching a threshold pressure, and a first check valve positioned between the first cylinder and the pressure storage chamber, wherein the first check valve is configured to open to permit air flow into the pressure storage chamber from the first cylinder, and wherein the check valve is a second check valve.

9. The powered fastener driver of claim 8, further comprising a head assembly positioned at a top end of the first and second cylinders, the head assembly defining the pressure storage chamber.

10. The powered fastener driver of claim 1, wherein the check valve is positioned between the second cylinder and the first cylinder, wherein the check valve is configured to open to permit air to flow into the first cylinder from the second cylinder, wherein the check valve is positioned above the first piston and below the second piston when the second piston is in the second top-dead-center position, and wherein the check valve is configured to receive air flow from air holes located in a bottom of the second cylinder and supply the first cylinder with air flow above the first piston while the second piston is located in the second top-dead-center position.

11. A powered fastener driver comprising:

a first cylinder;

a first piston positioned within the first cylinder, the first piston being moveable between a first top-dead-center position and a first bottom-dead-center position;

a pressure storage chamber in fluid communication with the first cylinder;

a second cylinder in selective fluid communication with the pressure storage chamber;

a second piston positioned within the second cylinder, the second piston being moveable between a second top-dead-center position and a second bottom-dead-center position to initiate a fastener driving operation;

a drive blade coupled to the second piston for movement therewith;

a pressure valve positioned between the pressure storage chamber and the second cylinder, wherein the pressure valve is configured to move from a closed position to an open position in response to the pressure within the pressure storage chamber reaching a threshold pressure;

a first check valve positioned between the first cylinder and the pressure storage chamber, wherein the first check valve is configured to open to permit air flow into the pressure storage chamber from the first cylinder;

a head assembly positioned at a top end of the first and second cylinders, the head assembly defining the pressure storage chamber, and a pressure sensor configured to detect the pressure within the pressure storage chamber, the pressure sensor electronically coupled to a control system of the powered fastener driver.

12. The powered fastener driver of claim 11, further comprising a reciprocating mechanism configured to drive the first piston between the first top-dead-center position and the first bottom-dead-center position, wherein the second piston is driven from the second top-dead-center position to the second bottom-dead-center position in response to the movement of the first piston.

13. The powered fastener driver of claim 11, wherein the pressure valve is a solenoid-actuated valve, and the pressure detected within the pressure storage chamber by the pressure sensor is utilized by the control system to determine when to energize the solenoid-actuated valve.

14. The powered fastener driver of claim 11, further comprising a second check valve positioned between the first and second cylinders, wherein the second check valve is configured to open to permit air to flow into the first cylinder from the second cylinder.

15. The powered fastener driver of claim 11, wherein the second piston includes a magnetic latch that interacts with an annular magnet positioned between the second cylinder and the pressure valve to hold the second piston in the top-dead-center position.

16. The powered fastener driver of claim 11, wherein the first piston has a non-circular shape.

17. A powered fastener driver comprising:

a first cylinder;

a first piston positioned within the first cylinder, the first piston being moveable between a first top-dead-center position and a first bottom-dead-center position;

a second cylinder in selective fluid communication with the first cylinder;

a second piston positioned within the second cylinder, the second piston being moveable between a second top-dead-center position and a second bottom-dead-center position to initiate a fastener driving operation;

a drive blade coupled to the second piston for movement therewith; and a check valve positioned between the second cylinder and the first cylinder, wherein the check valve is configured to open to permit air to flow into the first cylinder from the second cylinder, wherein the check valve is positioned above the first piston and below the second piston when the second piston is in the second top-dead-center position, wherein the check valve is configured to receive air flow from air holes located in a bottom of the second cylinder and supply the first cylinder with air flow above the first piston while the second piston is located in the second top-dead-center position, wherein the first piston has a kidney-bean shape.

18. The powered fastener driver of claim 17, further comprising a pressure storage chamber in selective fluid communication with the first cylinder, a first check valve positioned between the first cylinder and the pressure storage chamber, wherein the first check valve is configured to open to permit air flow into the pressure storage chamber from the first cylinder, and wherein the check valve is a second check valve.

19. The powered fastener driver of claim 17, further comprising a reciprocating mechanism configured to drive the first piston between the first top-dead-center position and the first bottom-dead-center position, wherein the second piston is driven from the second top-dead-center position to the second bottom-dead-center position in response to the movement of the first piston.

* * * * *